US007291044B1

(12) United States Patent
Lin

(10) Patent No.: US 7,291,044 B1
(45) Date of Patent: Nov. 6, 2007

(54) CABLE ASSEMBLY WITH WIRE SPACER

(75) Inventor: Yuan Chieh Lin, Forest Lake, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,266

(22) Filed: Jul. 3, 2006

(51) Int. Cl.
*H01R 9/03* (2006.01)

(52) U.S. Cl. ..... 439/610; 439/494

(58) Field of Classification Search ..... 439/610, 439/494, 497, 942

See application file for complete search history.

(56) References Cited

U.S. PATENT DOCUMENTS

| | | | | |
|---|---|---|---|---|
| 4,636,024 | A | 1/1987 | Yahata | |
| 5,118,306 | A * | 6/1992 | Bixler et al. | 439/405 |
| 5,425,657 | A * | 6/1995 | Davis et al. | 439/610 |
| 6,080,007 | A | 6/2000 | Dupuis | |
| 6,129,594 | A * | 10/2000 | Lai | 439/701 |
| 6,482,028 | B2 * | 11/2002 | Kumamoto et al. | 439/498 |
| 6,585,528 | B1 | 7/2003 | Lin | |
| 6,923,682 | B2 * | 8/2005 | Akama et al. | 439/610 |
| 6,984,150 | B2 * | 1/2006 | Kondou et al. | 439/606 |
| 7,040,918 | B2 * | 5/2006 | Moriyama et al. | 439/497 |

* cited by examiner

*Primary Examiner*—Hae Moon Hyeon
(74) *Attorney, Agent, or Firm*—Wei Te Chung

(57) ABSTRACT

A cable assembly (1) includes an insulative housing (10) with a number of passageways (121, 122), a number of terminals (50) received in the passageways of the insulative housing, an alignment plate (20) assembled on the rear end of the insulative housing, a number of cable (40) with a plurality of conductors (41, 42) and a wire spacer (30). The alignment plate includes a pair of positioning posts (211) at the opposite ends thereof. The wire spacer of dielectric material has a plurality of holes (32) defined therthrough and extending from one side to an opposite side thereof, each hole is for extension of one conductor of the plurality of cable therethrough, thereby facilitating organization of the wires for easing connection of each wire to the terminal, the wire spacer further comprises a pair of positioning holes (31) at opposite ends thereof, said positioning posts being received in the positioning holes of the alignment.

14 Claims, 9 Drawing Sheets

CABLE ASSEMBLY WITH WIRE SPACER

BACKGROUND OF THE INVENTION

Field of the Invention

The present invention relates to a high-speed cable connector assembly, and particularly to a high-speed cable connector assembly having a wire spacer.

A conventional high-speed cable connector assembly always has a dielectric housing, a conductive shroud, a printed circuit board attached to a rear side of the housing, and a plurality of contacts each having two ends, the forward end being mounted in the housing and the rearward end being soldered to a connecting pad on the printed circuit board.

High-speed data transmission cables require sophisticated shielding to protect the integrity of the data transmission. The shielding requirements create many problems during assembly of shielded cable ends. In particular, shielded wires in a cable have to be individually stripped and individually attached to corresponding pads on a rear of a component printed circuit board of a cable connector assembly. Problems in organizing the termination of many shielded wires to one small printed circuit board develop. Above problems result in a great complexity process and a high cost during assembly of a cable to a cable connector assembly.

So, a cable connector assembly having an improved structure is desired.

An object of the present invention is to provide a high-speed cable connector assembly with the cables can easily to be soldered to corresponding terminals.

To achieve the above object, A cable connector assembly comprises an insulative housing with a plurality of passageways, a plurality of terminals received in the passageways of the insulative housing, an alignment plate assembled on the rear end of the insulative housing, a number of cable with a plurality of conductors and a wire spacer. The alignment plate includes a pair of positioning posts at the opposite ends thereof. The wire spacer of dielectric material has a plurality of holes defined therethrough and extending from one side to an opposite side thereof, each hole is for extension of one conductor of the plurality of cable therethrough, thereby facilitating organization of the wires for easing connection of each wire to the terminal, the wire spacer further comprises a pair of positioning holes at opposite ends thereof, said positioning posts being received in the positioning holes of the alignment.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
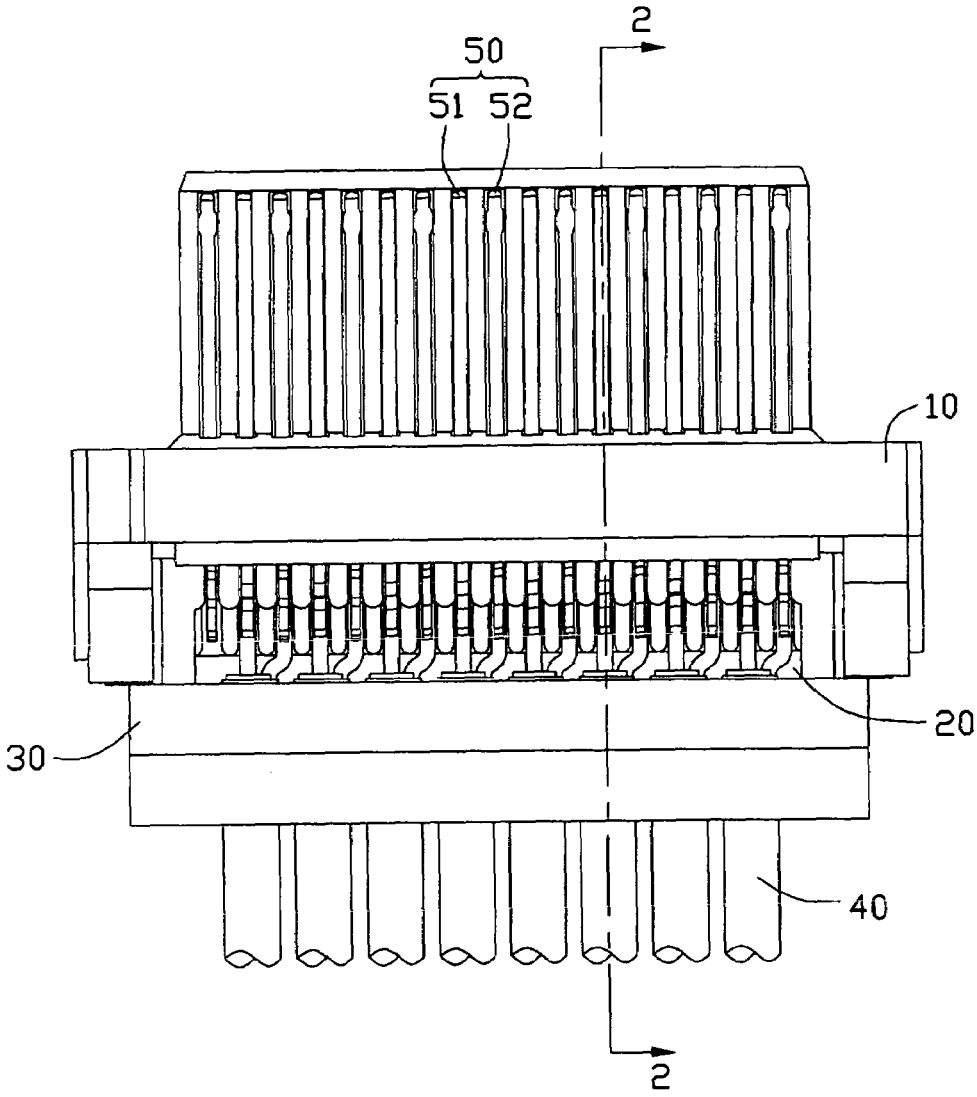
FIG. 1 is a top elevation view of a cable connector assembly in accordance with the present invention.
Figure 2:
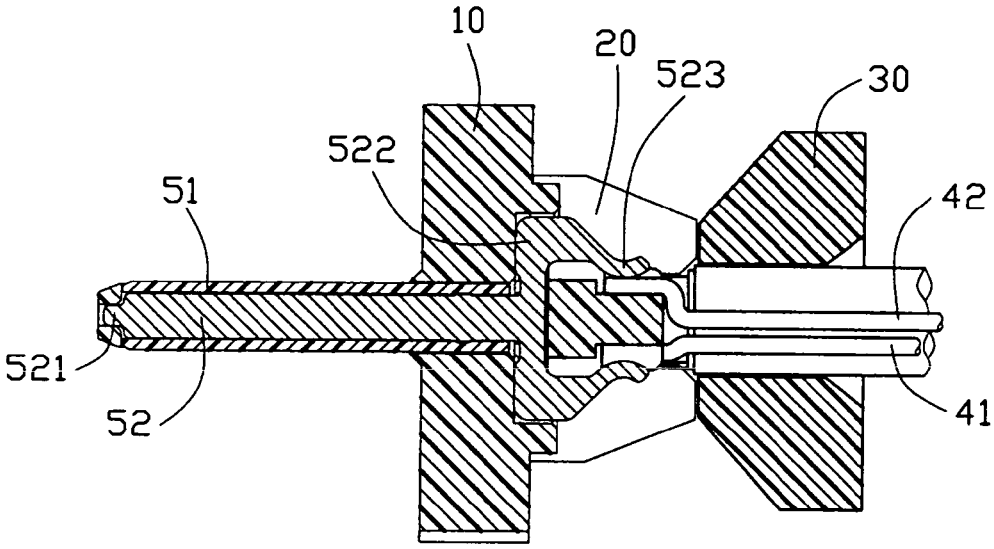
FIG. 2 is a cross-section view of the cable connector assembly shown in FIG. 1 along line 2-2.
Figure 3:
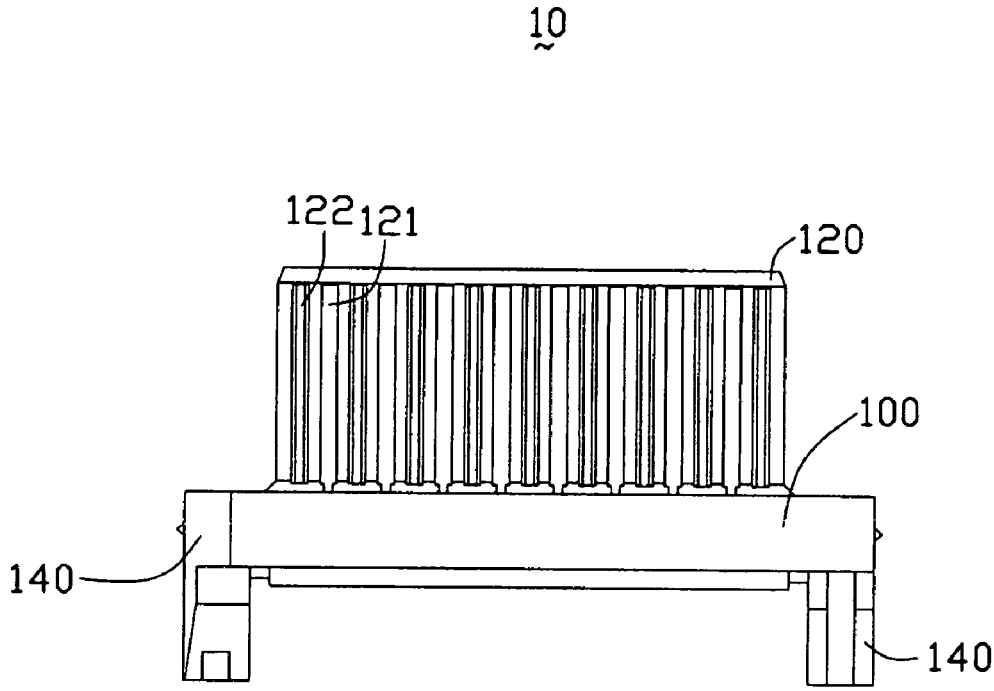
FIG. 3 is a top elevation view of a housing of the cable connector assembly.
Figure 4:
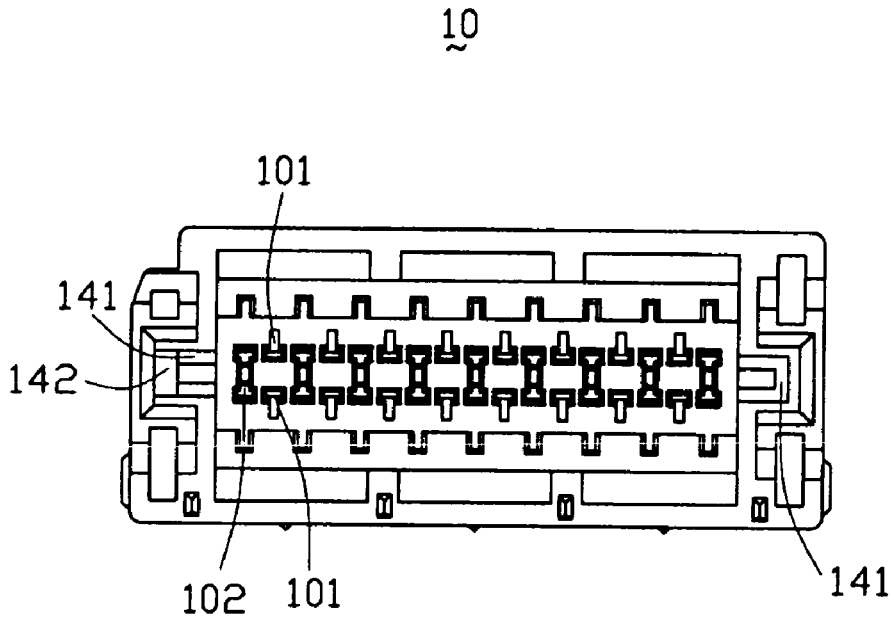
FIG. 4 is a rear elevation view of the housing shown in FIG. 3.
Figure 5:
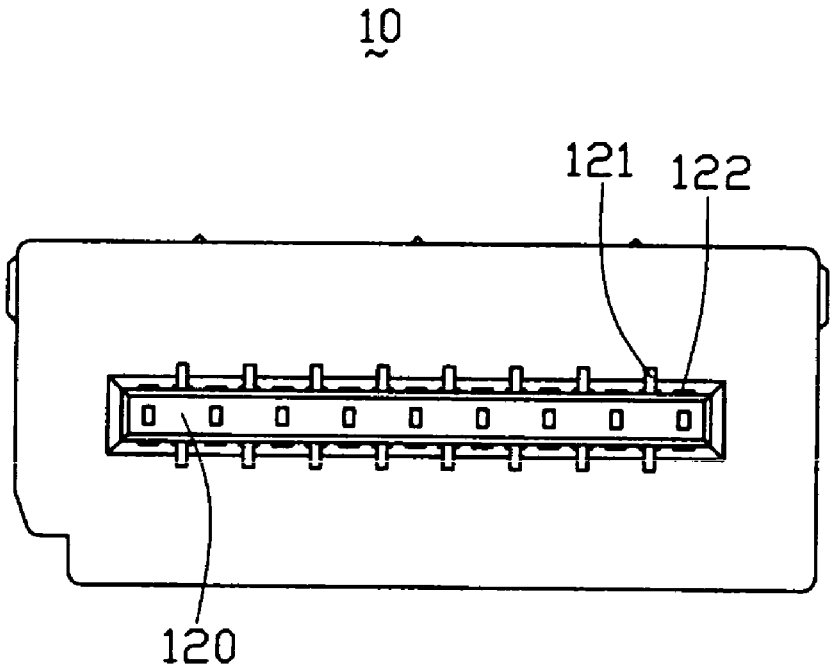
FIG. 5 is a front elevation view of the housing shown in FIG. 3.
Figure 6:
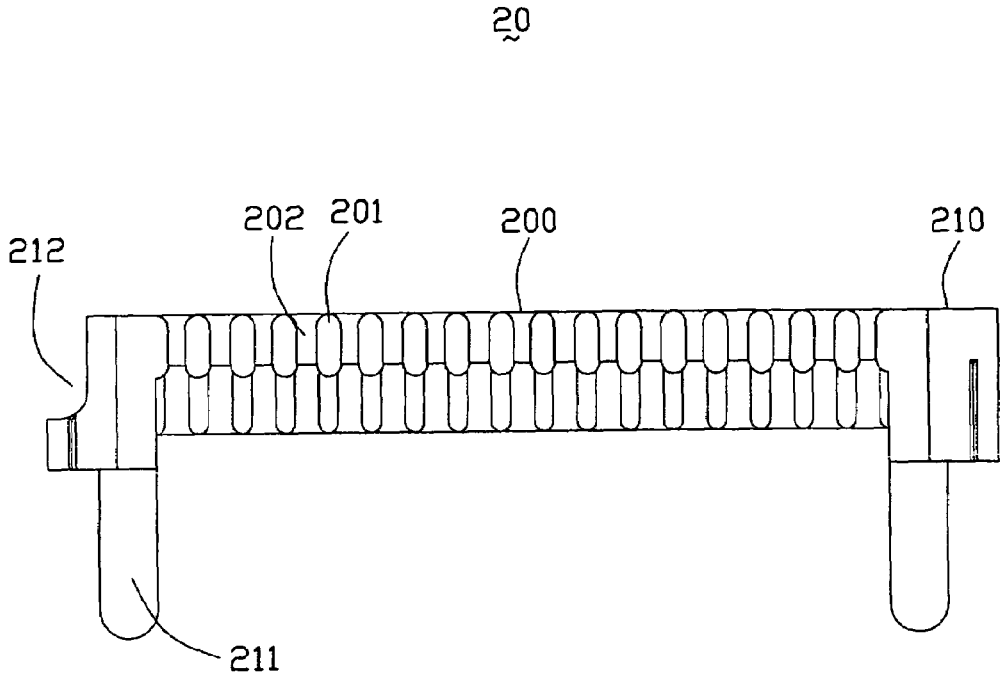
FIG. 6 is a top elevation view of an alignment plate of the cable connector assembly.
Figure 7:
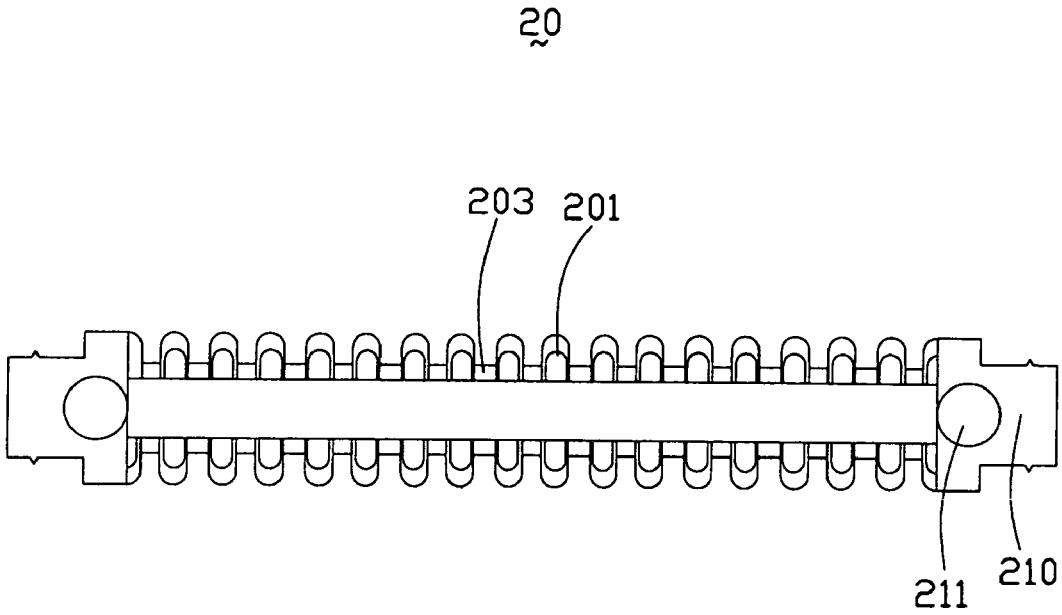
FIG. 7 is a rear elevation view of the alignment plate shown in FIG 6.
Figure 8:
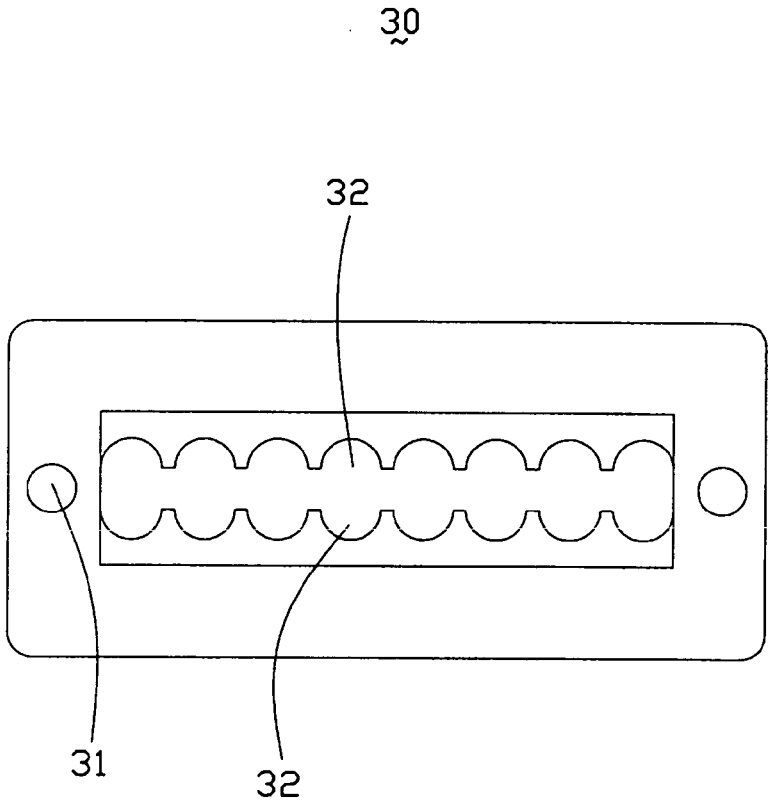
FIG. 8 is a rear elevation view of a wire spacer of the cable connector assembly.
Figure 9:
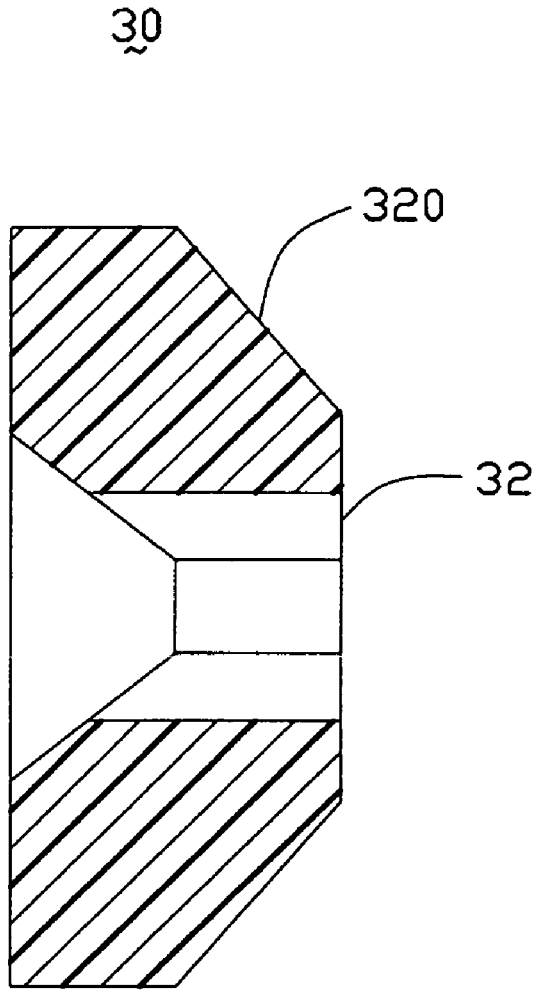
FIG. 9 is a cross-sectional view taken along line 9-9 of FIG. 8.

Referring to FIG. 1, a cable connector assembly in accordance with the present invention comprises an insulative housing 10, a plurality of terminals 50 received in the insulative housing 10, an alignment plate 20 assembled on a rear end of the insulative housing 10, a wire spacer 30 assembled behind the alignment plate 20 and a plurality of cables 40 electrically connecting with the terminals 50.

Particularly referring to FIGS. 2-5, the insulative housing 10 comprises a longitudinal main body 100 and a mating portion 120 extending forwardly from the main body 100. The main body 100 defines a plurality of first passageways 101 spaced arranged in two rows along a transverse direction, and a plurality of second passageways 102 arranged between every two first passageways. The mating portion 120 defines a plurality of first slits 121 and second slits 122 arranged alternately on the upper surface and the bottom surface thereof. The first slits 121 and second slits 122 communicate with corresponding first passageways 101 and second passageways 102 of the main body 100. The main body 100 further comprises a pair of lateral portions 140, respectively, extending backwardly from the opposite lateral ends thereof. Each lateral portion 140 defines a retaining slot 141 extending in the front-to-back direction. One of the retaining slots 141 forms a curved block 142 therein.

The terminals 50 comprise a plurality of signal terminals 51 received in the first passageways and first slits, and a plurality of grounding terminals 52 received in the second passageways and second slits. Each signal terminal 51 comprises a straight contacting portion (not shown), a stopping portion (not shown) bent upwardly/downwardly from the contacting portion and a tail portion (not shown) extending rearwardly from the stopping portion. The grounding terminal 52 comprises a contacting portion 521, a pair of stopping portion 522, respectively, bent upwardly and downwardly from the contacting portion 521, and a pair of tail portions 523, respectively, extending rearwardly from the stopping portions 522.

The comb-shape alignment plate 20 comprises a longitudinal base 200, a pair of end portions 210 formed at the opposite ends of the base 200. The base 200 comprises top portion (not labeled) and a bottom portion (not labeled) in mirror relationship with the top portion. The top portion forms a step 203, a plurality of posts 201 aligned alternately in a lateral direction formed a comb-shape. Every two posts 201 define a channel 202 therebetween. The bottom portion has the same structure with the top portion. Each end portion 210 comprises a positioning post 211 extending backwardly from the rear face thereof. One of the end portions 210 forms a depressing portion 212 corresponding to the block 142 of the retaining slot 141 of the housing 10.

The wire spacer 30 forms an angle engaging face 320 facing to the alignment plate 20, and comprises a pair of positioning holes 31 corresponding to the positioning posts 211 of the end portions 210, and a plurality of holes 32 extending therethrough. The holes 32 are arranged in upper and lower rows. Each hole 32 in upper row communicates with corresponding hole 32 in lower row via a middle slot defined through the wire spacer 30.

Each cable 40 comprises two conductors 41 and one grounding conductor 42, respectively, extending through the holes 32 of the wire spacer 30.

During assembly, the signal terminals 51 are, respectively, inserted into corresponding first passageways 101 of the main body 100 of the housing 10, and extending into the first slits 121 of the mating portion 120. The stopping portion of each signal terminal 51 resists the rear surface of the main body 100. The tail portions of the signal terminals 52 are disposed beyond the rear end of the housing 10. The grounding terminals 52 are, respectively, inserted into corresponding second passageways 102 of the main body 100 of the housing 10, and extending into the second slits 122 of the mating portion 120. The stopping portion 522 of each grounding terminal 52 resist the rear surface of the main body 100. The tail portions 523 of the grounding terminals 52 are disposed beyond the rear face of the housing 10. The alignment plate 30 assembled on the rear end of the housing 10 with the channels 202 receiving the tail portions of the terminals 50. Accordingly, the grounding terminal 52 has a fork-like tail having two spaced prongs located in the corresponding channels and defining a space for receiving and cooperating a corresponding portion of the alignment plate 30 to mechanically and electrically sandwich one corresponding grounding conductor 42 therebetween. The end portions 210 of the alignment plate 20 are received in the retaining slots 141 of the housing 10 for retaining the alignment plate 20 on the housing 10. The wire spacer 30 is assembled behind the alignment plate 20 with the positioning posts 211 of the alignment plate 20 inserted into the positioning holes 31. The grounding conductor 42 and the pair of the signal conductor 41 of each cable are inserted through corresponding holes 32 of the wire spacer 30 so that a length of each extends in front of the front side of the wire spacer 30, and then are soldered with the terminals 50 positioned in the channels 202 of the alignment plate 20. Obviously, grounding conductors 42 are soldered to the grounding terminals 52, and the signal conductors 41 are soldered to the signal terminals 51.

The alignment plate 20 is a comb shape component both side, so each combing space has different width on each end to confine and align the different sizes of the terminals 50 and conductors 41, 42 of cable. The angle engaging face 320 of the wire spacer 30 allows heat source, such as laser, solder iron, through to the termination area for welding or soldering.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

an insulative housing comprising a plurality of passageways;

a plurality of terminals received in the passageways of the insulative housing;

an alignment plate assembled on the rear end of the insulative housing, and comprising a pair of positioning posts at the opposite ends thereof;

a plurality of cables, each cable comprising a plurality of conductors; and a wire spacer of dielectric material having a plurality of holes defined therethrough and extending from one side to an opposite side thereof, each hole being for extension of one conductor of the plurality of cable therethrough, thereby facilitating organization of the conductors for easing connection of each conductor to the terminal, the wire spacer further comprising a pair of positioning holes at opposite ends thereof, said positioning posts being received in the positioning holes;

wherein the wire spacer having an angle engaging face facing to the alignment plate.

2. The cable connector assembly as claimed in claim 1, wherein the terminals comprises a plurality of signal terminals and a plurality of grounding terminals.

3. The cable connector assembly as claimed in claim 2, wherein the passageways comprises a plurality of the first passageways and a plurality of second passageways, said signal terminals are received in the first passageways and said grounding terminals are received in the second passageways.

4. The cable connector assembly as claimed in claim 2, wherein each cable comprising a pair of signal conductor and a grounding conductor, respectively, electrically connecting with corresponding signal terminals and grounding terminals.

5. The cable connector assembly as claimed in claim 1, wherein the insulative housing comprises a main body and a mating portion extending from the main body, said passageways are located in the insulative housing, and wherein the mating portion defines a plurality of slits at the top and bottom surface communicating with corresponding passageways.

6. The cable connector assembly as claimed in claim 5, wherein the main body comprises a pair of lateral portions extending from the opposite ends, each lateral portion comprises a retaining slot for retaining the alignment plate.

7. The cable connector assembly as claimed in claim 1, wherein the alignment plate comprises a base and a pair of end portions formed on the opposite ends of the base, said positioning posts are located at the end portions.

8. The cable connector assembly as claimed in claim 7, wherein the base of the alignment plate forms a step, and a plurality of posts arranged in a lateral direction on the step.

9. The cable connector assembly as claimed in claim 8, wherein every two posts define a channel receiving a rear end of the terminal and a front end of the conductor of the cable.

10. The cable connector assembly as claimed in claim 1, wherein the alignment is of a comb-like configuration.

11. A cable connector assembly comprising:

an insulative housing comprising a plurality of passageways;

a plurality of terminals received in the passageways of the insulative housing;

a comb-shape alignment plate assembled on the rear end of the insulative housing, and comprising a step thereon with a plurality of posts arranged in a lateral direction thereon;

a plurality of cables, each cable comprising a plurality of conductors; and a wire spacer of dielectric material having a plurality of holes defined therthrough and extending from one side to an opposite side thereof, each hole being for extension of one conductor of the plurality of cables therethrough, thereby facilitating organization of the conductors for easing connection of each conductor to the terminal; and the terminals including a plurality of signal terminals and a plurality of grounding terminals alternately arranged with each other, each of said grounding terminals defining a fork-like tail having thereof two spaced prongs respectively located in the corresponding channels and defining therebetween a space, said space receiving a corresponding portion of the alignment plate; wherein a grounding conductor is electrically and mechanically sandwiched between one corresponding prong and said corresponding portion of the alignment plate.

12. The cable connector assembly as claimed in claim 11, wherein the alignment plate comprises a pair of positioning posts at the opposite ends thereof, and wherein the wire spacer further comprising a pair of positioning holes at opposite ends thereof, said positioning posts being received in the positioning holes.

13. The cable connector assembly as claimed in claim 11, wherein the wire spacer has an angle engaging face.

14. A cable connector assembly comprising:

an insulative housing comprising a plurality of passageways in a front-to-back direction;

a plurality of terminals received in the passageways of the insulative housing;

a comb-shape alignment plate assembled on the rear end of the insulative housing, and comprising a step thereon with a plurality of posts arranged in a lateral direction thereon and defining a plurality of receiving channels each between every adjacent two posts;

a plurality of cables, each cable comprising a plurality of signal and grounding conductors; and a wire spacer of dielectric material having a plurality of holes defined therethrough and extending from one side to an opposite side thereof, each hole being for extension of one conductor of the plurality of cables therethrough, thereby facilitating organization of the conductors for easing connection of each conductors to the terminal; and the terminals including a plurality of signal terminals and a plurality of grounding terminals alternately arranged with each other, each of said grounding terminals cooperating with a portion of the alignment plate to mechanically and electrically sandwich one corresponding grounding conductor therebetween in a vertical direction perpendicular to said front-to-back direction.

* * * * *